US008450949B2

(12) United States Patent
Jheng et al.

(10) Patent No.: US 8,450,949 B2
(45) Date of Patent: May 28, 2013

(54) LED DRIVING DEVICE AND DRIVING SYSTEM THEREOF

(75) Inventors: Yang-Ci Jheng, Hsinchu (TW); Cheng-Jung Lee, Hsinchu (TW)

(73) Assignee: Macroblock, Inc., Hsinchu (TW)

( * ) Notice: Subject to any disclaimer, the term of this patent is extended or adjusted under 35 U.S.C. 154(b) by 272 days.

(21) Appl. No.: 13/101,489

(22) Filed: May 5, 2011

(65) Prior Publication Data

US 2011/0285325 A1 Nov. 24, 2011

(30) Foreign Application Priority Data

May 24, 2010 (TW) ..... 99116561 A

(51) Int. Cl.
*H05B 37/00* (2006.01)

(52) U.S. Cl.
USPC ..... 315/312; 315/295; 315/297; 315/307

(58) Field of Classification Search
USPC ..... 315/291, 294–295, 297, 307, 312
See application file for complete search history.

(56) References Cited

U.S. PATENT DOCUMENTS

2003/0057886 A1* 3/2003 Lys et al. ..... 315/291
2009/0128056 A1* 5/2009 Lin ..... 315/301
2010/0052558 A1* 3/2010 Lee et al. ..... 315/250

FOREIGN PATENT DOCUMENTS

JP 2006276626 A 10/2006
KR 100840074 B1 6/2008

OTHER PUBLICATIONS

Korean Patent Office, "Office Action", Aug. 22, 2012, Korea.

* cited by examiner

*Primary Examiner* — Jason M Crawford
(74) *Attorney, Agent, or Firm* — Morris Manning & Martin LLP; Tim Tingkang Xia, Esq.

(57) ABSTRACT

A light emitting diode (LED) driving device outputs a driving signal according to a select signal, an update data, and an update command. The driving device includes a buffer circuit, a display data storage, and a signal generating circuit. The buffer circuit includes register series and a bypass register. The buffer circuit selectively stores the update data in the register series and the bypass register according to the update command. The display data storage stores multiple display data. The display data storage updates the display data by using the update data stored in the register series according to the update command. The signal generating circuit outputs the driving signal according to the display data. When the update data is stored in the bypass register, the clock of the update data passing through the driver is reduced.

17 Claims, 6 Drawing Sheets

LED DRIVING DEVICE AND DRIVING SYSTEM THEREOF

CROSS-REFERENCE TO RELATED APPLICATIONS

This non-provisional application claims priority under 35 U.S.C. §119(a) on Patent Application No. 099116561 filed in Taiwan, R.O.C. on May 24, 2010, the entire contents of which are hereby incorporated by reference.

BACKGROUND OF THE INVENTION

1. Field of Invention

The present invention relates to a light emitting diode (LED) driving device and system, and more particularly to an LED driving device and system having a bypass register.

2. Related Art

In recent years, the manufacturing cost of light-emitting diodes (LEDs) has been greatly reduced. Therefore, LED displays have been widely applied in a variety of situations such as stadium and outdoor display panels.

The LED display usually uses tens of thousands of LEDs as the display pixels, and the LEDs are arranged in an array. LEDs respectively presenting different brightnesses form a picture, and multiple pictures presented in time sequence may form a dynamic image.

Besides, LEDs are usually used in backlight modules especially the direct-lit backlight modules for LCD screens. In the direct-lit backlight module, the LEDs are arranged in an array evenly distributed behind the LCD panel.

Generally speaking, the LEDs are driven by a driving device. The driving device sends a pulse width modulation (PWM) signal to drive the LEDs. The brightness of the LEDs is in direct proportion to the duty cycle of the PWM signal. The duty cycle of the PWM signal is determined by the value stored in a register of the driving device.

If LEDs arranged in an array are required to present different brightnesses, a multiple-bit register is needed to store the value of the duty cycle of the PWM signal. For example, if the LEDs are intended to present $2^N$ different brightnesses, an N-bit register is required to store N-bit brightness data.

To avoid using too many input ports, the registers are designed to be a serial shift register, and the brightness data is input in serial to the serial register. Furthermore, the shift register needs a clock signal to control. After the time of one clock, one bit signal may be input to one shift register. If N bit brightness data needs to be input to the serial shift register, the time of N clocks is required. In other words, when the input port of the serial shift register receives the signal corresponding to the brightness of one LED, the signal is completely received by one serial shift register after the time of N clocks. If one LED driving device may drive 16 LEDs, and each LED is controlled at the 12-bit brightness level, the time for each update of the driving device is the time of 192(12×16) clocks.

Generally speaking, LEDs arranged in an array (LED display screen or LED backlight module) are driven by multiple driving devices, and the driving devices are connected in series. Taking the 100×100 LED array as an example, each driver may drive 16 LEDs and each LED corresponds to 12-bit brightness level, and now 625 drivers are needed. But, if the 625 drivers are connected in series, the time of each update will be quite long. Therefore, in practice, the drivers for LEDs in the same row are connected in series, that is, 7 drivers are connected in series to form one row. However, this method has several deficiencies. First, part of the registers (144 registers corresponding to 12 LEDs) of the last driver are not used, which is a waste. Second, each row needs one I/O Port to control, so too many I/O ports are used. Third, if the brightness of only part of LEDs in one row needs updating, all the registers still need update, which is quite time-consuming.

SUMMARY OF THE INVENTION

In view of the above problems, the present invention is an LED driving device to reduce the delay time of data updating.

The present invention provides an LED driving device, which is used for generating a driving signal to drive multiple LEDs. The LEDs are arranged in an array. The driving device receives a latch enable (LE) signal, a serial data input (SDI) signal, and a clock signal, and outputs a serial data output (SDO) signal. The driving device comprises a recognition circuit, a switching circuit, at least one register circuit, and a buffer circuit.

The recognition circuit generates a mode switching signal according to the latch enable signal LE and the clock signal CLK.

The switching circuit receives the serial data input signal and stores the serial data input signal as a select signal or an update data according to the mode switching signal.

The register circuit comprises a first register series and a first selector. The register circuit has a first input port and a first output port, and the first input port is connected to the first register series and the first selector. The first register series is connected to the first selector. According to the select signal, the register circuit stores the update data in the first register series or bypasses the first register series to directly output the update data.

The buffer circuit and the at least one register circuit are connected in series. The buffer circuit comprises a second register series, a bypass register, and a second selector. The buffer circuit has a second input port and a second output port. The input port is connected to the bypass register and the second register series, and the second register series and the bypass register are connected to the second selector. The buffer circuit stores the update data in the second register series or outputs the update data via the bypass register according to the select signal.

The buffer circuit comprises a register series and a bypass register. The buffer circuit selectively stores the update data in the register series and the bypass register according to the select signal.

The display data storage stores multiple display data. The display data storage updates the display data by using the update data stored in the register series according to the update command.

The signal generating circuit outputs the driving signal according to the display data.

The present invention further provides an LED driving device. The driving device outputs a driving signal according to a select signal, an update data, and an update command. The driving signal is used for adjusting the brightness of the LEDs selected by the select signal.

The buffer circuit comprises a register series and a bypass register. The buffer circuit selectively stores the update data in the register series and the bypass register according to the select signal.

The display data storage stores multiple display data. The display data storage updates the display data by using the update data stored in the register series according to the update command.

The signal generating circuit outputs the driving signal according to the display data.

More particularly, the buffer circuit further comprises an input port, an output port, and a selector. The input port of the buffer circuit is connected to an input port of the register series and an input port of the bypass register. An output port of the register series and an output port of the bypass register are respectively connected to two input ports of the selector. An output port of the selector is connected to the output port of the buffer circuit. The selector selectively connects the output port of the register series or the output port of the bypass register to the output port of the buffer circuit according to the select signal.

The driving circuit further comprises a data output port. The data output port is connected with the output port of the buffer circuit. The data output port may output the update data, thus enabling the multiple driving devices to be connected in series.

In another aspect, the driving device further comprises multiple register circuits. The register circuits and the buffer circuit are connected in series. The register circuits and the buffer circuit selectively store the update data in the display data storage respectively according to the select signal.

Each register circuit comprises an input port, an output port, a register series, a bypass line, and a selector. The input port of the register circuit is connected to an input port of the register series and an input port of the bypass line. An output port of the register series and an output port of the bypass line are respectively connected to two input ports of the selector. An output port of the selector is connected to the output port of the register circuit. The selector selectively connects the output port of the register series or the output port of the bypass line to the output port of the register circuit according to the select signal.

The driving device stores the update data in the register series or outputs the update data via the bypass register according to the select signal. When the update data is stored in the bypass register, the clock of the update data passing through the driver is reduced.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

The detailed features and advantages of the present invention are described below in great detail through the following embodiments, the content of the detailed description is sufficient for those skilled in the art to understand the technical content of the present invention and to implement the present invention there accordingly. Based upon the content of the specification, the claims, and the drawings, those skilled in the art can easily understand the relevant objectives and advantages of the present invention. The following embodiments are intended to describe the present invention in further detail, but not intended to limit the scope of the present invention in any way.

Figure 1:
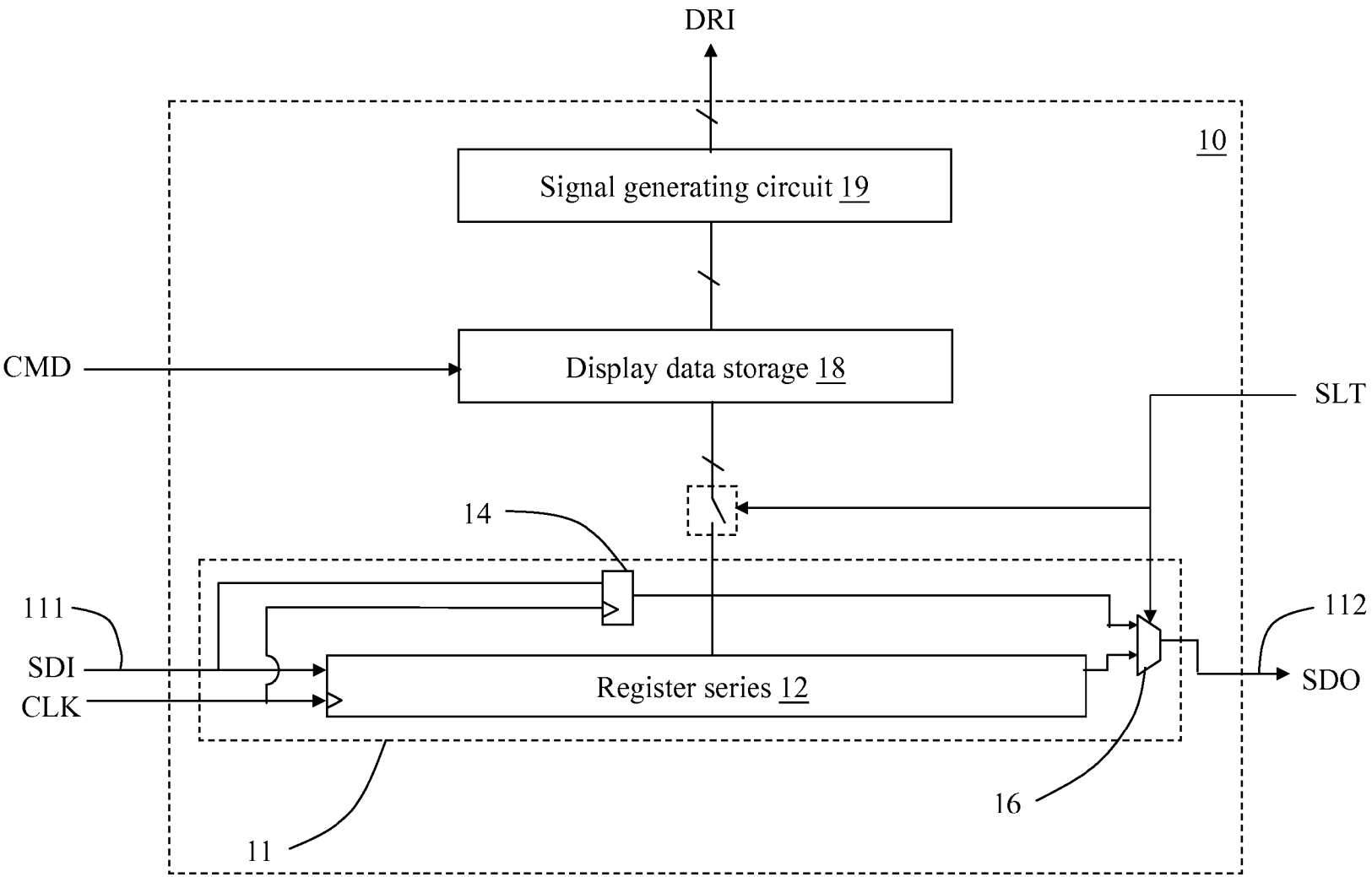
FIG. 1 is a block diagram of a system according to a first embodiment of the present invention.

Referring to FIG. 1, a block diagram of a system according to a first embodiment of the present invention is shown. The LED driving device 10 comprises a buffer circuit 11, a display data storage 18, and a signal generating circuit 19. The buffer circuit 11 further comprises a register series 12, a bypass register 14, and a selector 16.

The buffer circuit 11 comprises an input port 111 and an output port 112. The input port 111 is connected to the register series 12 and the bypass register 14. The register series 12 and the bypass register 14 are connected to the selector 16. The selector 16 is connected to the output port 112.

The driving device 10 is used for receiving a select signal SLT, a serial data input signal SDI, and an update command CMD, and outputting a driving signal DRI. The select signal SLT and the serial data input signal SDI are input in serial to the driving device 10.

The driving device 10 has two different operation modes, namely, a channel selection mode and a data transfer mode. Users may input a mode select signal to select the channel selection mode or data transfer mode of the driving device 10. For example, when the mode select signal is at low level, the driving device 10 is in the channel selection mode. When the mode select signal is at high level, the driving device 10 is in the data transfer mode.

First, in channel selection mode, users may transfer the select signal SLT to the selector 16. The selector 16 selectively connects the register series 12 or the bypass register 14 to the output port according to the select signal SLT. In more detail, the select signal SLT may be an enable signal or a disable signal. When the select signal SLT is enable signal, the selector 16 connects the register series 12 to the output port, and cuts off the connection between the bypass register 14 and the output port. When the select signal SLT is disable signal, the selector 16 connects the bypass register 14 to the output port, and cuts off the connection between the register series 12 and the output port.

Then, in the data transfer mode, the serial data input signal SDI received by the driving device 10 is stored in the register series 12 and the bypass register 14. Since the output of the selector 16 has been selected, data of the register series 12 or the bypass register 14 is output to serve as the serial data output signal SDO.

In this embodiment, the driving device 10 may receive a clock signal CLK. The clock signal CLK is formed by multiple interleaved high levels and low levels. The position of the clock signal CLK transiting from the high level to the low level is referred to as the falling edge, and the position of the clock signal CLK transiting from the low level to the high level is referred to as the rising edge. One cycle of the clock signal CLK is defined by the time between two neighboring falling edges or the time between the two neighboring rising edges.

In the data transfer mode, the driving device 10 persists receiving the clock signal CLK, and transfers the clock signal CLK to the register series 12 and the bypass register 14. After every one cycle of the clock signal CLK, the register series 12 and the bypass register 14 store 1 bit data and output 1 bit data.

The register series 12 may be a first in first out (FIFO) shift register. The register series 12 is formed by N unit registers connected in series, and each unit register stores 1 bit data. The unit register may be a D flip-flop. After one cycle, data stored in the unit register is shifted to a next unit register. In other words, after one cycle, data stored in the first unit register is shifted and stored in the second unit register, and the data stored in the second unit register is shifted and stored in the third unit register, and so forth. The data input to the register series 12 is delayed for N cycles and then output by the register series 12.

In another aspect, the bypass register 14 may be regarded as the register formed by one unit register. The data after input to the bypass register 14 is delayed for one cycle and then output by the register series 12. The bypass register 14 may be used for synchronization. If the bypass register 14 is not provided, the data may produce the RC (resistance-capacitance) delay effect due to the parasitic capacitance on the line. The RC delay effect may induce a longer cycle of the clock signal CLK, which influences the delay time of the driving device 10.

The driving device 10 may further comprise a data output port. The data output port is connected to the output port of the buffer circuit 11. The data output port outputs a serial data output signal SDO, thus enabling the multiple driving devices 10 to be connected in series.

In view of the above, the combination of the register series 12, the bypass register 14, and the selector 16 may be regarded as one register with a variable length. When the select signal SLT is an enable signal, the length of the register with variable length is N bit. When the select signal SLT is a disable signal, the length of the register with variable length is 1 bit. That is to say, the delay time of the driving device 10 is controlled by the select signal SLT.

Besides, the driving device 10 comprises a display data storage 18. The display data storage 18 and the register series 12 are connected by a bus. The signal input to the driving device 10 further comprises an update command CMD. The update command CMD may be transferred to the display data storage 18. After receiving the update command CMD, the display data storage 18 may capture display data in the register series 12 and update the data in the display data storage 18.

In order to ensure the data captured by the display data storage 18 is the accurate serial data input signal SDI, the display data storage 18 is selectively enabled or disabled by the select signal SLT. That is to say, only when the select signal SLT is an enable signal and the display data storage 18 receives an update command CMD, the display data storage 18 captures the display data in the register series 12 and stores the display data.

The signal generating circuit 19 outputs the driving signal DRI according to the display data. The driving signal DRI may be a PWM signal or a value of grey scale brightness. If the output driving signal DRI is the PWM signal, the driving signal DRI may drive one or more LEDs.

Based on the above, the driving device 10 stores the serial data input signal SDI in the register series 12 or outputs the serial data input signal SDI via the bypass register 14 according to the select signal SLT. When the serial data input signal SDI is output via the bypass register 14, the delay time of the driving device 10 may be greatly reduced.

For example, if twenty driving devices 10 are connected in series and each driving device 10 stores 192 bits. If the data of the tenth driving device 10 needs updating, according to the conventional method, each driving device 10 needs the time of 192 clock signals CLK. Therefore, in the conventional method, 1920 cycles of the clock signal CLK are required to finish the update of data in the tenth driving device 10. However, according to the driving device 10 of the invention, the select signal SLT may be input to disable the front nine driving devices 10. Then, when the serial data input signal SDI is input to the disabled driving devices, the serial data input signal SDI is output after passing only one bypass register 14. That is to say, only one cycle of the clock signal CLK is required. Therefore, the driving device 10 of the invention only needs 192 cycles plus 9 cycles of a bypass signal, i.e., overall 201 cycles of the clock signal CLK to finish the update of data in the tenth driving device 10.

Therefore, the driving device 10 according to the present invention may greatly reduce the delay time of data updating.

Figure 2:
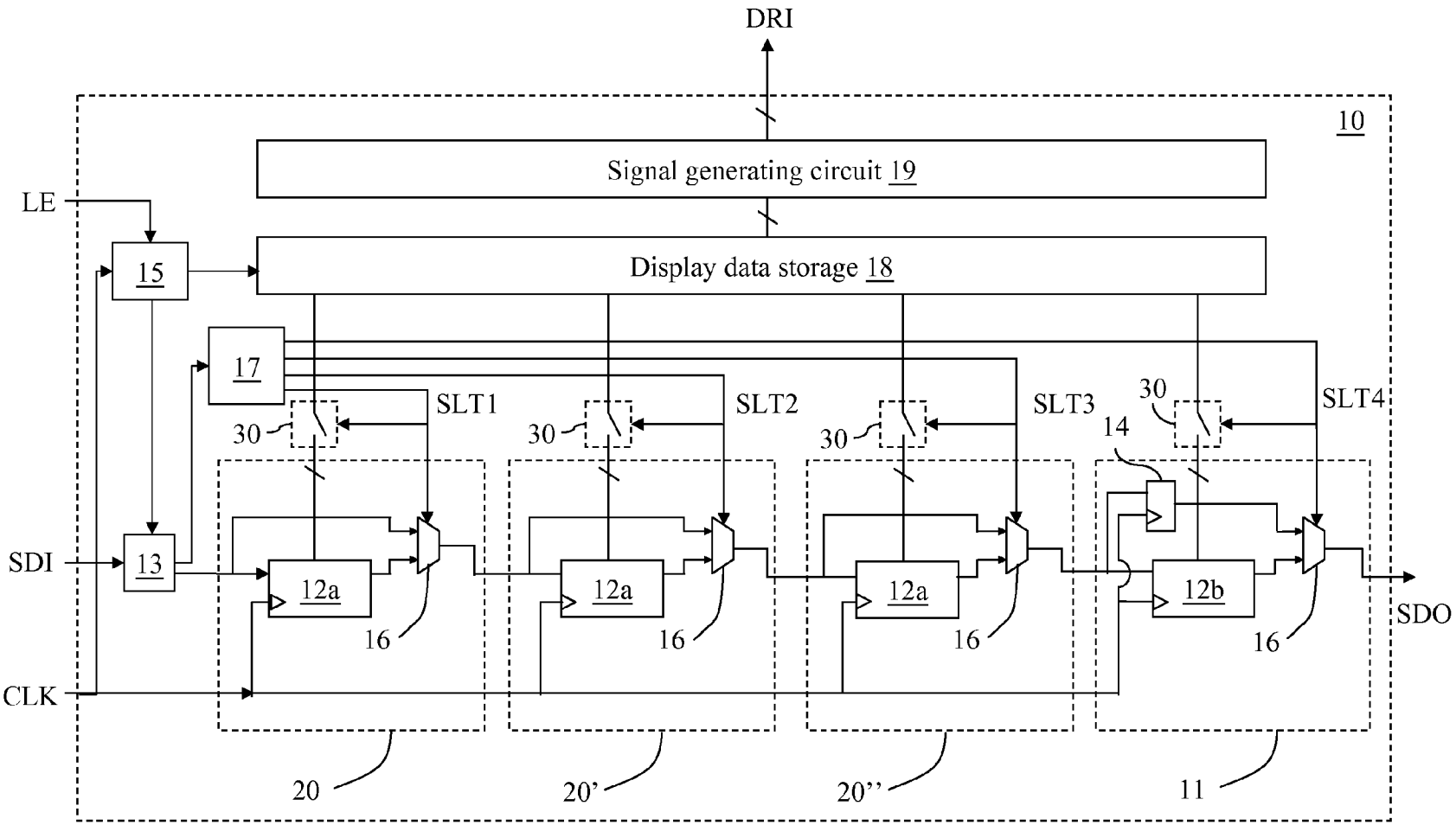
FIG. 2 is a block diagram of a system according to a second embodiment of the present invention.

In order to increase the application flexibility of the driving device 10, the driving device 10 may adopt the following structure. Referring to FIG. 2, a block diagram of a system according to a second embodiment of the present invention is shown. The driving device 10 comprises a buffer circuit 11, multiple register circuits 20, 20', 20", a recognition circuit 15, and a switching circuit 13. The buffer circuit 11 and the register circuit 20 are connected in series.

The LED driving device 10 is used for generating a driving signal DRI to drive multiple LEDs. The LEDs are arranged in an array. The driving device 10 receives a latch enable (LE) signal, a serial data input (SDI) signal, and a clock signal CLK, and outputs a serial data output (SDO) signal.

The recognition circuit 15 generates a mode switching signal according to the latch enable signal LE and the clock signal CLK. In more detail, the recognition circuit 15 compares the length of the latch enable signal LE in time with one cycle of the clock signal CLK, so as to generate the mode switching signal.

The mode switching signal is used for selecting the channel selection mode and the data transfer mode.

The switching circuit 13 receives the serial data input signal SDI and stores the serial data input signal SDI as a select signal or an update data according to the mode switching signal. In more detail, if the length of the latch enable signal LE in time comprises one cycle of the clock signal CLK, the serial data input signal SDI is stored as the select signal (e.g. SLT1, SLT2, SLT3 and SLT4) in the select signal register 17. If the length of the latch enable signal LE in time comprises two cycles of the clock signal CLK, the serial data input signal SDI is stored as the update data in the selected first register series 12*a*. The length of the latch enable signal LE in time is defined as the time from the rising edge to the falling edge. The cycle of the clock signal CLK is defined as the time between two neighboring rising edges or the time between two neighboring falling edges.

The buffer circuit 11 comprises a second register series 12*b*, a bypass register 14, and a selector 16. The buffer circuit 11 comprises an input port and an output port. The input port of the buffer circuit 11 is connected to the first register series 12*a* and the bypass register 14. The first register series 12*a* and the bypass register 14 are connected to the selector 16. The selector 16 is connected to the output port of the buffer circuit 11.

The register circuit 20 comprises a first register series 12*a* and a selector 16. The register circuit 20 comprises an input port and an output port. The input port of the register circuit 20 is connected to the first register series 12*a* and the selector 16. The first register series 12*a* is connected to the selector 16. The selector 16 is connected to the output port of the register circuit 20.

In this embodiment, three register circuits (the register circuit 20, the register circuit 20', and the register circuit 20") are provided. The register circuits 20, 20', 20" are connected in series, and then connected in series with the buffer circuit 11. In addition to the method disclosed in this embodiment, the buffer circuit 11 may also be connected in series with the register circuit 20, the register circuit 20', and the register circuit 20".

The driving device 10 has two different operation modes, namely the channel selection mode and the data transfer mode. The two different modes are selected by the mode switching signal generated by the recognition circuit 15.

First, in the channel selection mode, the select signals SLT1, SLT2, SLT3 and SLT4 received by the input port are respectively transferred to the register circuits 20, 20', 20" and the selector 16 of the buffer circuit 11.

The selector 16 of the buffer circuit 11 selectively connects the second register series 12*b* or the bypass register 14 to the output port according to the select signal SLT4. In more detail, when the select signal SLT4 is an enable signal, the selector 16 connects the second register series 12*b* to the output port, and cuts off the connection between the bypass register 14 and the output port. When the select signal SLT4 is a disable signal, the selector 16 connects the bypass register 14 to the output port, and cuts off the connection between the second register series 12*b* and the output port.

The selector 16 of the register circuit 20 selectively connects the first register series 12*a* or the bypass line to the output port according to the select signal SLT1. When the select signal SLT1 is an enable signal, the selector 16 connects the first register series 12*a* to the output port, and cuts off the connection between the bypass line and the output port. When the select signal SLT1 is a disable signal, the selector 16 connects the bypass line to the output port, and cuts off the connection between the first register series 12*a* and the output port.

The operation methods of the register circuit 20' and the register circuit 20" are the same as that of the register circuit 20, and the details will not be described herein.

Then, in the data transfer mode, the serial data input signal SDI is transferred to the register circuit 20, the register circuit 20', the register circuit 20", and the buffer circuit 11 sequentially. Finally, the buffer circuit 11 outputs the serial data output signal SDO. The register circuit 20, the register circuit 20', the register circuit 20", and the buffer circuit 11 respectively outputs different signals according to the select signals SLT1, SLT2, SLT3 and SLT4 corresponding to each selector 16.

For example, if the select signals SLT1, SLT3 are disable signals, and the select signals SLT2, SLT4 are enable signals, the first and second register series 12a, 12*b* of the register circuit 20' and the buffer circuit 11 are updated, and the data in the register circuit 20 and the register circuit 20" is directly output via the bypass line. That is to say, the serial data input signal SDI is only stored in the enabled register circuit 20 or buffer circuit 11.

Besides, the driving device 10 comprises a display data storage 18. The display data storage 18 and the first and second register series 12*a*, 12*b* are connected by a bus. After the serial data input signal SDI is completely input, the display data storage 18 parallelly captures the display data of the first and second register series 12*a*, 12*b* of each enabled register circuit 20 or buffer circuit 11 by the bus, and updates the data in the display data storage 18.

In order to capture the accurate serial data input signal SDI, the display data storage 18 is connected to the first and second register series 12*a*, 12*b* by an electronic switch module 30. In this embodiment, the electronic switch module 30 may be an AND gate or a transistor. The electronic switch module 30 is controlled by the select signal, and only when the select signals SLT1, SLT2, SLT3 and SLT4 are enable signals and an update command CMD is received, the electronic switch module 30 is conducted. That is to say, when the electronic switch module 30 is conducted, the display data storage 18 captures the display data of the first and second register series 12*a*, 12*b* and stores the display data in the display data storage 18.

The signal generating circuit 19 outputs the driving signal DRI according to the display data. The driving signal DRI may be a PWM signal or a value of the grey scale brightness.

In order to make sure that the data of the registers of the disabled register circuit or buffer circuit will not be updated, the input of the clock signal CLK is controlled.

Figure 3:
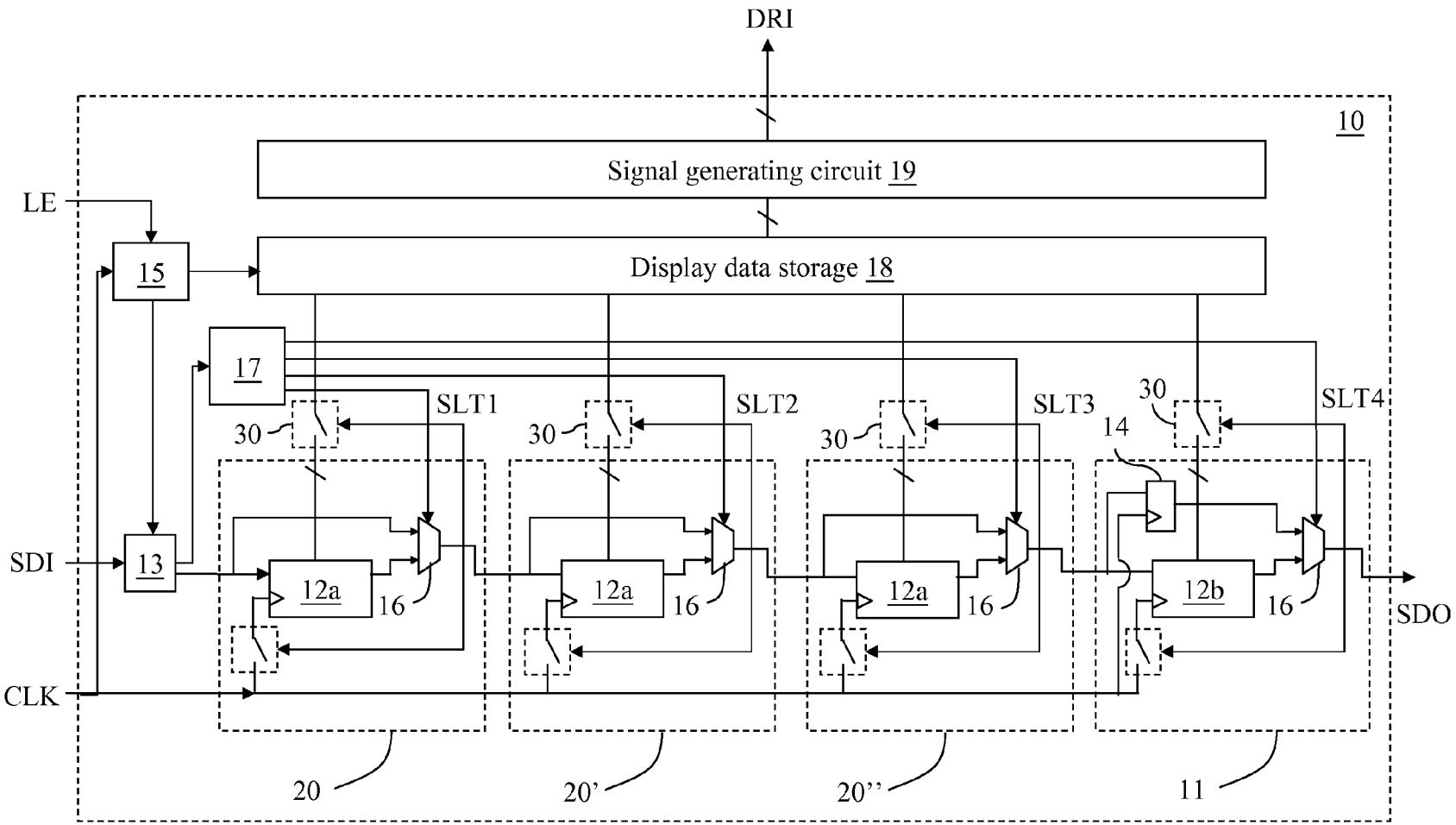
FIG. 3 is a block diagram of a system according to a third embodiment of the present invention.

Referring to FIG. 3, a block diagram of a system according to a third embodiment of the present invention is shown.

The buffer circuit 11 and the register circuit 20 may comprise an electronic switch module 30. The electronic switch module 30 is controlled according to the select signals SLT1, SLT2, SLT3 and SLT4. When the select signals SLT1, SLT2, SLT3 and SLT4 are disable signals, the electronic switch module 30 cuts off the input of the clock signal CLK. In this manner, the serial data input signal SDI cannot be input to the first and second register series 12*a*, 12*b* of the buffer circuit 11 and the register circuit 20.

Figure 4:
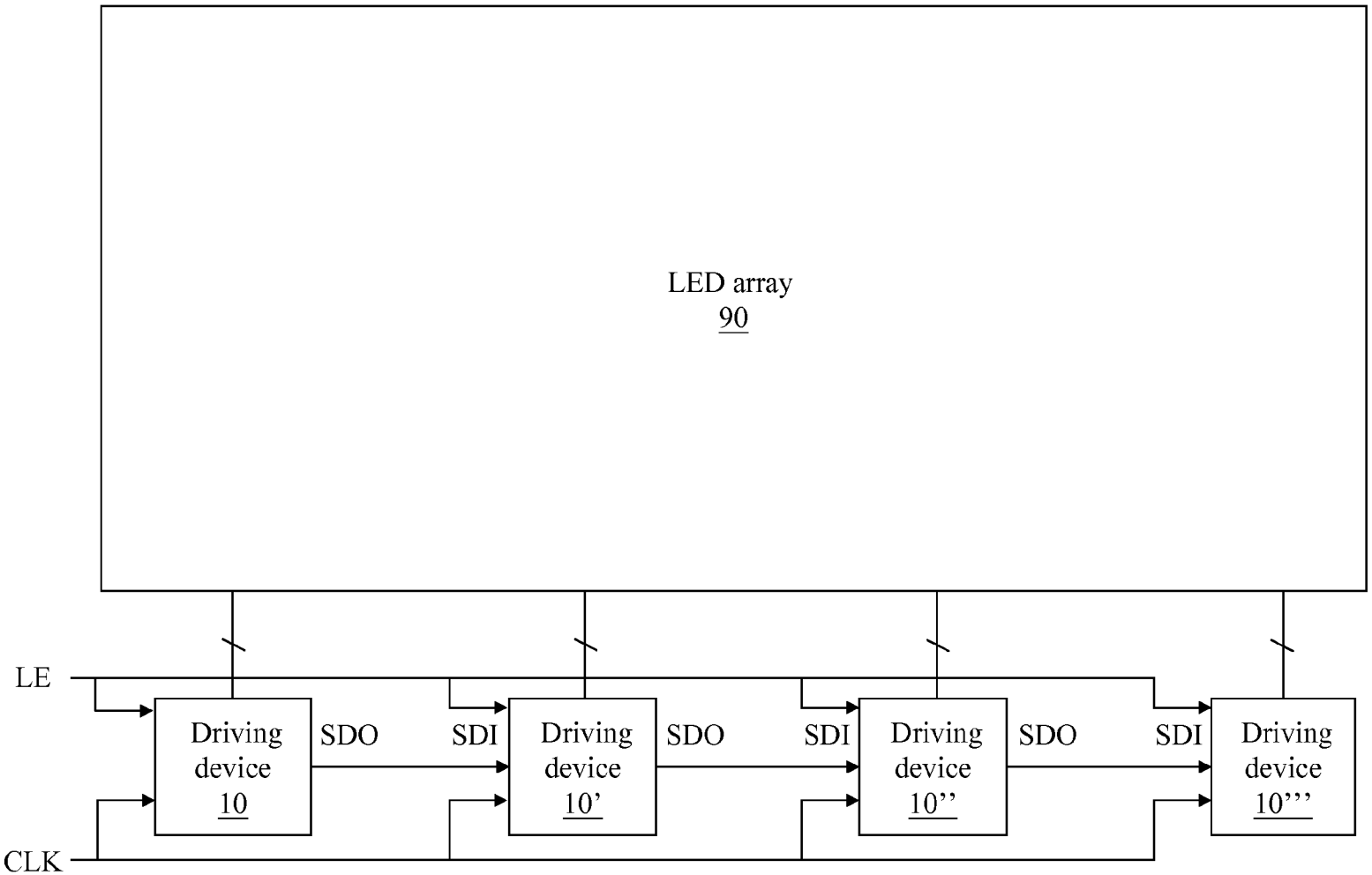
FIG. 4 is an architectural view of a system adopting a driving device of the present invention.

Referring to FIG. 4, an architectural view of a system adopting the driving device of the present invention is shown. The driving devices 10, 10', 10" and 10"' are connected in series. The serial data output signal SDO output by the driving device 10 is the serial data input signal SDI of the driving device 10'. The serial data output signal SDO output by the driving device 10' is the serial data input signal SDI of the driving device 10". The serial data output signal SDO output by the driving device 10" is the serial data input signal SDI of the driving device 10"'. Furthermore, the driving device 10, 10', 10" and 10"' share one latch enable signal LE and one clock signal CLK.

Figure 5:
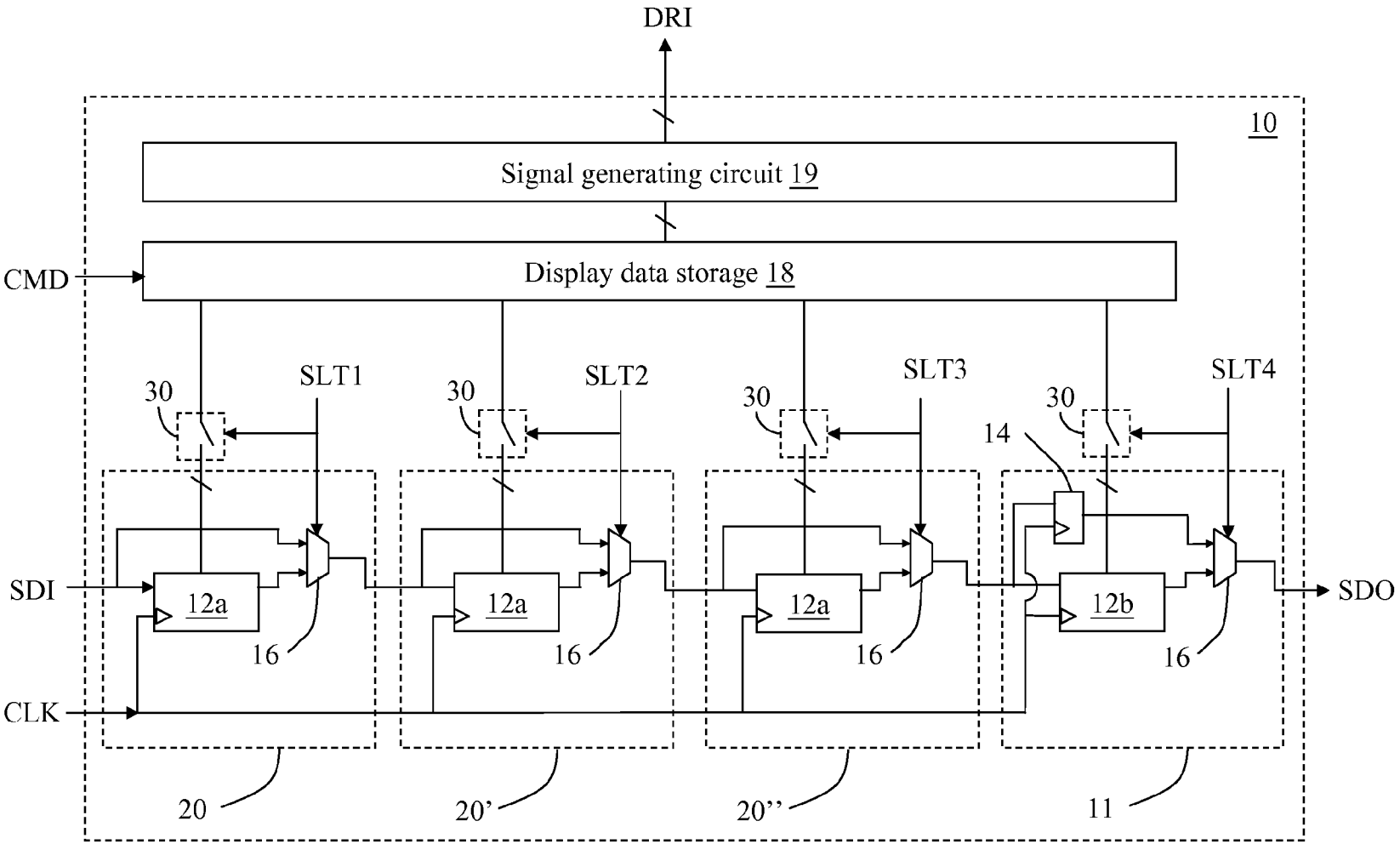
FIG. 5 is a block diagram of a system according to a forth embodiment of the present invention.

Referring to FIG. 5, a block diagram of a system according to a forth embodiment of the present invention is shown. The driving device 10 comprises a buffer circuit 11 and multiple register circuits 20. The buffer circuit 11 and the register circuits 20 are connected in series.

The buffer circuit 11 comprises a second register series 12*b*, a bypass register 14, and a selector 16. The buffer circuit 11 comprises an input port and an output port. The input port of the buffer circuit 11 is connected to the second register series 12*b* and the bypass register 14. The second register series 12*b* and the bypass register 14 are connected to the selector 16. The selector 16 is connected to the output port of the buffer circuit 11.

The register circuit 20 comprises a first register series 12*a* and a selector 16. The register circuit 20 comprises an input port and an output port. The input port of the register circuit 20 is connected to the first register series 12*a* and the selector 16. The first register series 12*a* is connected to the selector 16. The selector 16 is connected to the output port of the register circuit 20.

The driving device 10 is used for receiving the select signal, the serial data input signal SDI, and the update command CMD, and outputting the driving signal DRI and the serial data output signal SDO. The select signal may be four different select signals SLT1, SLT2, SLT3 and SLT4. The select signals SLT1, SLT2, SLT3 and SLT4 and the serial data input signal SDI are input in serial to the driving device 10. The driving device 10 has two different operation modes, namely the channel selection mode and data transfer mode. The two different modes respectively correspond to receiving the select signals SLT1, SLT2, SLT3 and SLT4 and receiving the serial data input signal SDI.

First, in the channel selection mode, the select signals SLT1, SLT2, SLT3 and SLT4 received by the input port are respectively transferred to the register circuits 20, 20', 20" and the selector 16 of the buffer circuit 11.

The selector 16 of the buffer circuit 11 selectively connects the second register series 12*b* or the bypass register 14 to the output port according to the select signal SLT4. In more detail, when the select signal SLT4 is an enable signal, the selector 16 connects the second register series 12*b* to the output port, and cuts off the connection between the bypass register 14 and the output port. When the select signal SLT4 is a disable signal, the selector 16 connects the bypass register 14 to the output port, and cuts off the connection between the second register series 12*b* and the output port.

The selector 16 of the register circuit 20 selectively connects the first register series 12*a* or the bypass line to the output port according to the select signal SLT1. When the select signal SLT1 is an enable signal, the selector 16 connects the first register series 12*a* to the output port, and cuts off the connection between the bypass line and the output port. When the select signal SLT1 is a disable signal, the selector 16 connects the bypass line to the output port, and cuts off the connection between the first register series 12*a* and the output port.

The operation methods of the register circuit 20' and the register circuit 20" are the same as that of the register circuit 20, and the details will not be described herein.

Then, in the data transfer mode, the serial data input signal SDI is transferred to the register circuit 20, the register circuit 20', the register circuit 20", and the buffer circuit 11 sequentially. Finally, the buffer circuit 11 outputs the serial data output signal SDO. The register circuit 20, the register circuit 20', the register circuit 20", and the buffer circuit 11 respectively output different signals according to the select signals SLT1, SLT2, SLT3 and SLT4 corresponding to each selector 16.

Besides, the driving device 10 comprises a display data storage 18. The display data storage 18 and the first and second register series 12*a*, 12*b* are connected by a bus. The serial data input signal SDI input to the driving device 10 further comprises an update command CMD. The update command CMD may be transferred to the display data storage 18. After receiving the update command CMD, the display data storage 18 parallelly captures the display data of the first and second register series 12*a*, 12*b* of each enabled register circuit 20 or buffer circuit 11 by the bus, and updates the data in the display data storage 18.

In order to capture the accurate serial data input signal SDI, the display data storage 18 is connected to the first and second register series 12*a*, 12*b* by an electronic switch module 30. In this embodiment, the electronic switch module 30 may be an AND gate or a transistor. The electronic switch module 30 is controlled by the select signal, and only when the select signals SLT1, SLT2, SLT3 and SLT4 are enable signals and an update command CMD is received, the electronic switch module 30 is conducted. That is to say, when the electronic switch module 30 is conducted, the display data storage 18 captures the display data of the first and second register series 12*a*, 12*b* and stores the display data in the display data storage 18.

The signal generating circuit 19 outputs the driving signal DRI according to the display data. The driving signal DRI may be a PWM signal or a value of the grey scale brightness.

In order to make sure that the data of the register of the disabled register circuit or buffer circuit will not be updated, the input of the clock signal CLK is controlled.

Figure 6:
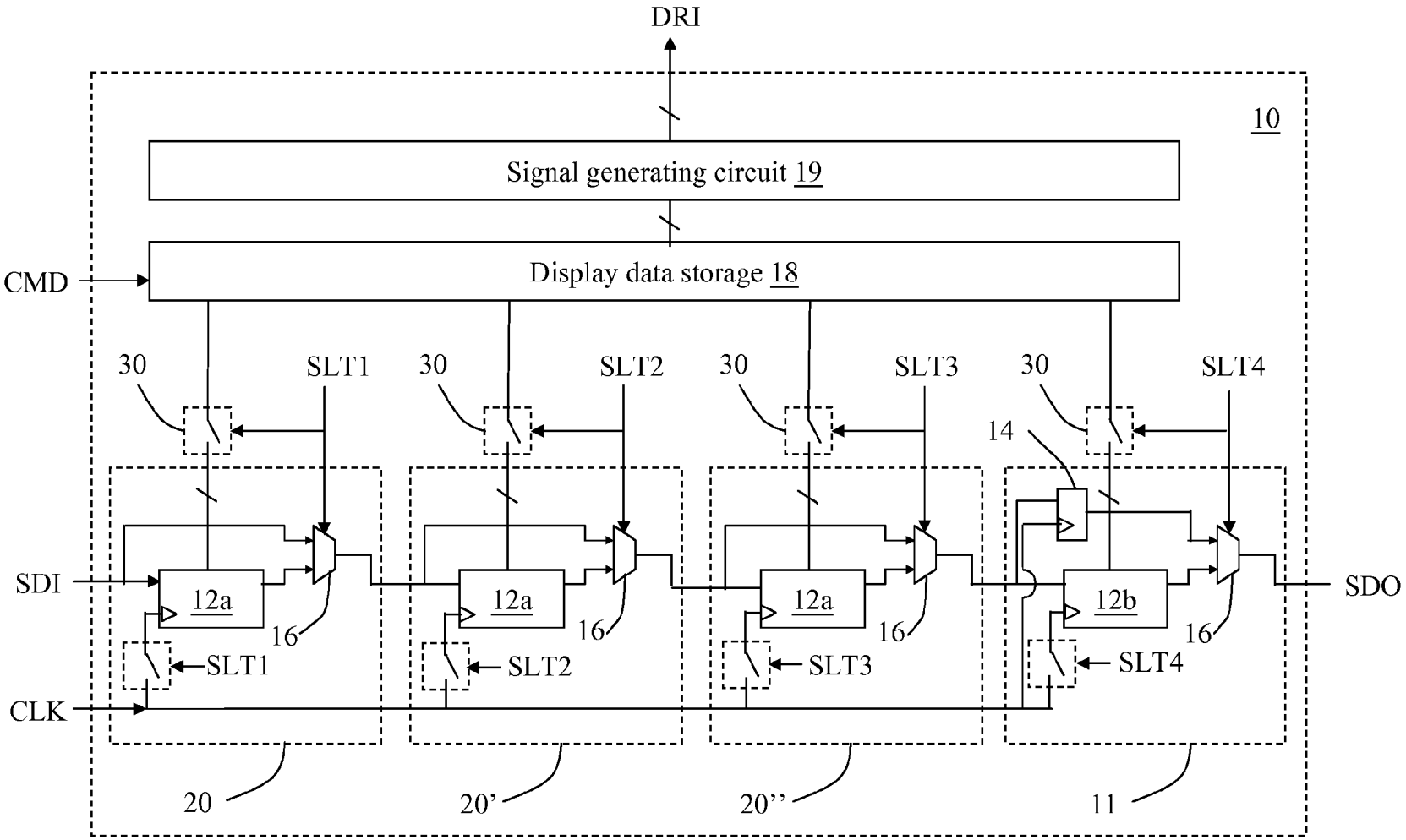
FIG. 6 is a block diagram of a system according to a fifth embodiment of the present invention.

Referring to FIG. 6, a block diagram of a system according to a fifth embodiment of the present invention is shown. The driving device 10 comprises a buffer circuit 11, multiple register circuits 20, 20', 20", a display data storage 18, and a signal generating circuit 19. The buffer circuit 11 and the register circuit 20 are connected in series.

The buffer circuit 11 and the register circuit 20 may comprise an electronic switch module 30. The electronic switch module 30 is controlled according to the select signals SLT1, SLT2, SLT3 and SLT4. When the select signals SLT1, SLT2, SLT3 and SLT4 are disable signals, the electronic switch module 30 cuts off the input of the clock signal CLK. In this manner, the serial data input signal SDI cannot be input to the first and second register series 12*a*, 12*b* of the buffer circuit 11 and the register circuit 20.

Through controlling the driving device by multiple select signals, multiple register series may totally or partially store the update data, or all the register series are disabled. Therefore, the data stored in the driving device may be flexibly adjusted according to multiple select signals. Furthermore, when the update signal is connected to the selector via the bypass register or the bypass line, the clock of the update signal passing through the driving device is greatly reduced.

What is claimed is:

1. A light emitting diode (LED) driving device, for generating a driving signal to drive multiple LEDs, wherein the LEDs are arranged in an array, the driving device receives a latch enable signal, a serial data input signal, and a clock signal, and outputs a serial data output signal, the driving device comprising:

a recognition circuit, for generating a mode switching signal according to the latch enable signal and the clock signal;

a switching circuit, for receiving the serial data input signal and storing the serial data input signal as a select signal or an update data according to the mode switching signal;

at least one register circuit, comprising a first register series and a first selector, wherein the register circuit has a first input port and a first output port, the first input port is connected to the first register series and the first selector, the first register series is connected to the first selector, and the register circuit stores the update data in the first register series or bypasses the first register series to directly output the update data according to the select signal;

a buffer circuit, connected in series with the at least one register circuit, and comprising a second register series, a bypass register, and a second selector, wherein the buffer circuit has a second input port and a second output port, the second port is connected to the bypass register and the second register series, the second register series and the bypass register are connected to the second selector, and the buffer circuit stores the update data in the second register series or outputs the update data via the bypass register according to the select signal;

a display data storage, for storing multiple display data, and electrically connected to the first register series and the second register series, wherein the display data storage updates the display data according to the update data stored in the first register series and the second register series; and a signal generating circuit, for outputting the driving signal according to the display data.

2. The LED driving device according to claim 1, wherein the first register series and the second register series comprise multiple unit registers, and the unit registers are connected in series.

3. The LED driving device according to claim 2, wherein the unit registers and the bypass register are D flip-flops.

4. The LED driving device according to claim 1, wherein the recognition circuit compares a time length of the latch enable signal with a cycle of the clock signal, so as to generate the mode switching signal.

5. The LED driving device according to claim 4, wherein when the time length of the latch enable signal comprises one cycle of the clock signal, the switching circuit stores the serial data input signal as the select signal, and when the time length of the latch enable signal comprises two cycles of the clock signal, the switching circuit stores the serial data input signal as the update data.

6. The LED driving device according to claim 1, wherein the buffer circuit and the register circuit comprise an electronic switch, and the clock signal is selectively input by the electronic switch to the buffer circuit and the register circuit according to the select signal.

7. A light emitting diode (LED) driving system, comprising a plurality of LED driving devices according to claim 1, wherein the LED driving devices are connected in series, and the serial data output signal output by one of the LED driving devices is the serial data input signal received by another LED driving device.

8. A light emitting diode (LED) driving device, for driving a plurality of LEDs, wherein the LEDs are arranged in an array, the driving device outputs a driving signal according to a select signal, an update data, and an update command, and the driving signal is used for adjusting brightness of the LEDs selected by the select signal, the driving device comprising:

at least one register circuit, comprising a first register series and a first selector, wherein the register circuit has a first input port and a first output port, the first input port is connected to the first register series and the first selector, the first register series is connected to the first selector, and the first selector selectively connects the first register series or the first input port to the first output port;

a buffer circuit, connected in series with the at least one register circuit, and comprising a second register series, a bypass register, and a second selector, wherein the buffer circuit has a second input port and a second output port, the second input port is connected to the bypass register and the second register series, the second register series and the bypass register are connected to the second selector, and the second selector selectively connects the second register series or the bypass register to the second output port;

a display data storage, for storing multiple display data, and electrically connected to the first register series and the second register series, wherein the display data storage updates the display data by using data stored in the first register series and the second register series according to the update command; and a signal generating circuit, for outputting the driving signal according to the display data.

9. The LED driving device according to claim 8, wherein the first register series, the second register series, and the bypass register comprise a clock input port, the clock input port is used for inputting a clock signal, and after one cycle of the clock signal, the first register series, the second register series, and the bypass register output 1 bit update data.

10. The LED driving device according to claim 9, wherein the buffer circuit and the register circuit comprise an electronic switch, and the clock signal is selectively input by the electronic switch to the clock input port according to the select signal.

11. The LED driving device according to claim 8, wherein the first register series and the second register series comprise multiple unit registers, and the unit registers are connected in series.

12. The LED driving device according to claim 11, wherein the unit registers are D flip-flops.

13. A light emitting diode (LED) driving device, for driving multiple LEDs, wherein the LEDs are arranged in an array, the driving device outputs a driving signal according to a select signal, an update data, and an update command, and the driving signal is used for adjusting brightness of the LEDs selected by the select signal, the driving device comprising:

a buffer circuit, comprising a first register series, a bypass register, and a selector, wherein the buffer circuit has an input port and an output port, the input port is connected to the bypass register and the first register series, the first register series and the bypass register are connected to the selector, and the selector selectively connects the first register series or the bypass register to the output port;

a display data storage, for storing multiple display data, and electrically connected to the first register series, wherein the display data storage updates the display data by using data stored in the first register series according to the update command; and a signal generating circuit, for outputting the driving signal according to the display data.

14. The LED driving device according to claim 13, wherein the first register series and the bypass register comprise a clock input port, the clock input port is used for inputting a clock signal, and after one cycle of the clock signal, the first register series and the bypass register output 1 bit update data.

15. The LED driving device according to claim 14, wherein the buffer circuit and the register circuit comprise an electronic switch, and the clock signal is selectively input by the electronic switch to the clock input port according to the select signal.

16. The LED driving device according to claim 13, wherein the register series comprise multiple unit registers, and the unit registers are connected in series.

17. The LED driving device according to claim 16, wherein the unit registers are D flip-flops.

* * * * *